United States Patent [19]

Kajitani

[11] 4,017,992

[45] Apr. 19, 1977

[54] DECORATIVE SHEET

[75] Inventor: Akira Kajitani, Onojo, Japan

[73] Assignee: Toshikiyo Shiraki, Fukuoka, Japan

[22] Filed: Aug. 11, 1975

[21] Appl. No.: 603,388

[52] U.S. Cl. ..... 40/138

[51] Int. Cl.[2] ..... G09F 7/06

[58] Field of Search ..... 40/138, 130 J, 125 E, 40/28 C

[56] References Cited

UNITED STATES PATENTS

| | | | |
|---|---|---|---|
| 2,912,778 | 11/1959 | Battaglia | 40/138 |
| 2,965,978 | 12/1960 | Olson | 40/142 A X |
| 2,969,606 | 1/1961 | Battaglia | 40/138 |
| 3,189,183 | 6/1965 | Thrasher | 40/138 X |
| 3,206,882 | 9/1965 | Thatcher | 40/138 |

*Primary Examiner*—John F. Pitrelli
*Attorney, Agent, or Firm*—Armstrog, Nikaido & Marmelstein

[57] ABSTRACT

Decorative sheet is provided which comprises four component parts; a base sheet, a decorative circular sheet, a support and a rivet. The sheet provides a novel sense of beauty produced by the shaking in a breeze of numerous decorative circular sheets having various colors.

9 Claims, 3 Drawing Figures

DECORATIVE SHEET

BACKGROUND OF THE INVENTION

This invention relates to a decorative sheet having numerous shaking pieces. More particularly, this invention relates to a decorative sheet having a base sheet, a plurality of circular supports integrally formed with the base sheet and a plurality of circular sheets mounted on the supports. The circular sheets are held in position on the base sheet by rivets passing through the supports and base sheet. The supports maintain a predetermined distance between the base sheet and circular sheet.

The decorative sheet according to this invention is set up perpendicular to the line of sight and provides a novel sense of beauty to the observer as a whole, due to the shaking by a breeze of numerous circular decorative sheets having various color. Thus, the object of this invention lies in using it for various decorations, advertisement media, etc. Accordngly, as the decorative sheet of this invention is mainly used in the out-of-doors, care must be taken with each part, so as to be able to display its effect sufficiently.

DETAILED DESCRIPTION OF THE PREFERRED EMBODIMENT

Figure 1:
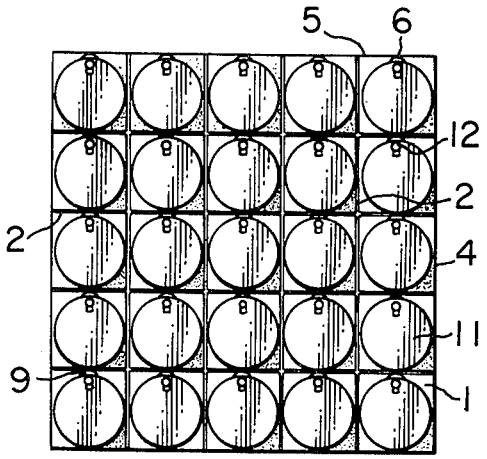
FIG. 1 is a front view of the decorative sheet of this invention.
Figure 2:
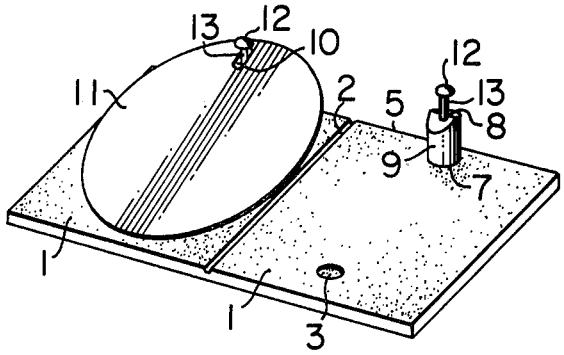
FIG. 2 is a partial oblique view of this invention, in which a part of the decorative circular sheet is removed.
Figure 3:
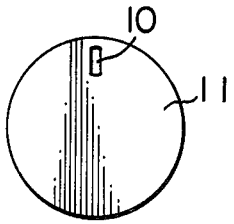
FIG. 3 is a plan view of the decorative circular sheet of this invention.

Referring to the drawings, numerous grooves 2 intersect at right angles on the surface of base sheet 4, and unit squares 1 having the same size are formed. Each of the squares 1 has a corresponding decorative circular sheet 11 having the same form from the point of decoration. The base sheet 4 has a thickness sufficient to provide the necessary mechanical strength. The grooves 2 on the surface of base sheet 4 facilitate the shaping of the decorative sheet. Namely, the base sheet 4 is cut by folding it along the groove 2. This is performed principally by hand. Accordingly, the depth of grooves 2 is set so as to conform to this function.

The use of thermoplastic synthetic resin is considered from the point of lightness, corrosion resistance, productivity and material price, especially as a thermoplastic synthetic resin has properties such as ease of cutting by folding and a beautiful finish. High impact polystyrene has been found to be excellent in such properties.

"High impact polystyrene" is a general term for the graft-polymerized polymer of styrene and synthetic rubbers such as polybutadiene and styrene-butadiene rubber, etc. But, it also includes a simple mixture of polystyrene and various synthetic rubbers. These are easily obtainable on the general market. Although the back of base sheet 4 is maintained to be flat and should be able to adhere to the support of decorative sheet, it is desirable to make a proper number of holes 3 for putting fastening screws through the base sheet 4 of the decorative sheet according to this invention. This enables a strong and safe contact of base sheet 4 with the support of decorative sheet.

The circular support 9 stands erect inside each unit square 1 on the base sheet 4. The circular support 9 is positioned so that the circular section which forms the bottom 7 of circular support 9 contacts the center of the upper side 5 of the unit squares 1 formed by grooves 2 intersected at right angles. This position is suitable for the object of enlarging the extent of shaking of the decorative circular sheet 11 described as follows. It is desirable that the diameter of circular support 9 is as small as possible. This is controlled by the size of rivet 13 described below and the size of both inclined planes near the top part 8 of circular support 9 which is essential to the effective shaking of decorative circular sheet 11. In this invention, the most suitable size of the diameter of the circular support 9 is approximately 7/30 of the side length of unit square 1. It has been found that the most suitable height of the circular support 9 is approximately 13/30 of the side of unit square 1 from the point of effective shaking of decorative circular sheets 11. The special important point in this invention is the form of circular support 9 near the top part 8. The top part 8 of circular support 9 has an edge which has a parallel relation with upper side 5 of unit square 1 and passes through the center line of circular support 9 from the judgement that the effect of beauty may be more increased by concentrating the shaking of decorative circular sheet 11 primarily in the vertical direction. Thus, the horizontal shaking of decorative circular sheet 11 is restricted greatly. Further, two inclined planes are installed making the edge as a border.

In this invention, an inclined angle against the base sheet 4 of the two inclined planes has an important meaning. It is not desirable to make the inclined angle too small because the shaking extent of decorative circular sheet 11 is restricted. From this point, it is desirable to have a large inclined angle. However, if the angle is too large, two defects result. That is: in rainy days, the side of circular sheet 11 opposite to hole 10 is adhered to the base sheet 4 by water-drops and becomes difficult to separate, and in windy days, the decorative circular sheet 11 is lifted upward so much that the unattractive parts of the back are exposed. As these conditions are often continued for a long period, undesirable results are caused in both cases. As a result of research in removing these defects, the inventor has found that the most suitable angle between the two inclined planes which form the edge of the top part 8 of circular support 9 and the base sheet 4 is approximately 35°.

The base sheet 4 and circular support 9 may be formed as a single unit of pellets of thermoplastic synthetic resin such as high impact polystyrene colored in given colors. The single units can be formed with a general injection molding machine. The decorative circular sheets 11 are held by rivets 13 which pass through circular supports 9 to the base sheet 4. The circular sheets 11 are arranged in rows up and down, and right and left on the base sheet 4. Accordingly, the existence of some spaces between the circular sheets 11 is desirable, and the diameter of circular sheets 11 is made to be slightly smaller than the side length of the unit square 1. For example, if the length of side unit square 1 is 30 mm., the diameter of decorative circular sheet 11 may be 29 mm. In the decorative circular sheet 11, a small hole 10 is positioned near the circumference. The position and form of a small hole 10 may be decided by the size of head 12 of rivet 13 and the extent of shaking of decorative circular sheet 11. The hole 10 has straight sides and circular ends having a length of about 2/15 of the side length of unit square 1 and a width of about 1/15 of the side length of unit square 1 with a center at a position of about 1/10 of the side length of unit square 1 from the circumference on said diameter as a suitable example.

The decorative circular sheets 11 has the following characteristics: thin thickness and lightness in weight so it can easily shake in a breeze; a light load against the support of the decorative sheet; weather-proof; and a material which will accept a rich color. As a material which satisfies such conditions, the inventor has found that polycarbonate resin having the content of about 10 to 50% of polymethyl methacrylate is suitable. The superiority of this resinous composition is attributable to its pearl-like lustre. The resinous composition is obtained by mixing readily available resins, and in order to make the decorative circular sheet 11, a proper quantity of dyestuff which gives a desirable color is added to the resinous composition according to the necessity, and then a sheet is obtained under the combination of a extruder and a T-die. And continuously, a sheet having approximately 0.2mm. in thickness is obtained by calendar-roll in soft state. It is also desirable that the decorative circular sheet 11 have a reflective rear surface because it is desirable that the circular sheet 11 glitter by the action of reflected light. For this purpose, aluminum may be adhered using a vacuum deposition, or aluminum foil may be pasted on the back side of said sheet. Thus, the decorative circular sheet 11 having a desirable form is obtained by press cutting from a sheet prepared as above.

The rivet 13 is inserted through hole 10 in the decorative circular sheet 11 and passes through the center of top part 8 of circular support 9. The lower end of the rivet 13 is retained in the bottom of base sheet 4. For this purpose, previously during the formation of base sheet 4 and circular support 9 as one body, a hole for the rivet 13 having a slightly smaller diameter than that of rivet 13 is made at the same time. The form of head part 12 of said rivet 13 is a hemisphere which forms a sphere on the upper part having a diameter which is slightly larger than the width of the hole 10 in the decorative circular sheet 11, and it is possible to insert the decorative circular sheet 11. The shape of the head part 12 and the hole 10 facilitate the insertion of decorative circular sheet 11 and prevents the detachment of said circular sheet 11 from the rivet 13. The length and diameter of the neck part in rivet 13 from the lower part of head part 12 of rivet 13 to the top part 8 of circular support 9 are approximately 1/15 of side length of unit square 1, in order to facilitate the shaking of decorative circular sheet 11 in the vertical direction. When weather-proofing of rivet 13 is desired, anti-corrosive aluminum and stainless steel may be selected as the materials, but in case of indoor use, aluminum may be suitable. The rivet 13 may be driven easily into the hole for the rivet 13, which was previously made in the circular support 9 and base sheet 4.

Summarizing the description above, the preferred embodiment of this invention is as follows.

That is: (1) A thick base sheet 4 having grooves 2 intersected at right angles, thereby forming numerous unit squares 1 on the surface. The base sheet 4 has holes 3 for screwing; and (2) Circular supports 9 stand erect on the base sheet 4. The support 9 having a top part 8 formed by the intersection of two planes, one which is parallel to the upper side 5 of unit squares 1 and passes through a certain point on the center line of support 9, and the other forming an angle of 35° with the base sheet 4. The support 9 has a height equivalent to about 13/30 of the side length of unit square 1, and a diameter equivalent to about 7/30 of one side length of unit square 1. (3) The base sheet 4 and support 9 are formed of a high impact polystyrene as one body. (4) A thin decorative circular sheet 11 comprises a colored or clear polycarbonate resinous composition containing polymethyl methacrylate, which has a diameter slightly smaller than the side length of unit square 1 and has a hole 10 therein with straight sides and circular ends with a length of about 22/15 of the side length in unit square 1 and a width of about 1/15 of side length in unit square 1 with a center at a position of about 1/10 of side length of unit square from the circumference on the diameter and which has a reflective plane on the rear surface. (5) A rivet 13 passes through the center of head part 8 of circular support 9 to the bottom of base sheet 4 and has a head 12 with a slightly larger diameter than the width of the hole 10 of the decorative circular sheet 11, making it possible to insert the decorative circular sheet 11, the head part having a hemisphere shape to form a sphere on the upper part with the length and diameter of neck part 12 from its lower part to the top part 8 of the circular support 9, about 1/15 of the side length of unit square 1, so as to intersect at right angles with base sheet 4. An example of the decorative sheet according to this invention is as follows.

The decorative sheet is used as the base sheet 4 being 2mm. in thickness with the grooves being 1 mm. in depth. The base 4 has 100 unit squares 1 having 30 mm. sides, and may be used to extend in two dimensional directions. The decorative sheet is prepared by making the whole decorative sheet the same color, or giving various shades to the decorative circular sheets 11 blackening the other parts. Letters and designs may also be used on circular sheets 11.

Accordingly, it is possible to use it as a medium for advertisement or outdoor decoration and it is possible to use it in place of a neon sign. It is also possible to use it for an arrangement on a show stage or in a show window using an artificial wind for indoor use. Further, the decorative sheet of this invention can be used as a wreath for all ceremonies, as pictures for children's color education, or as a letter sheet for a calendar which can be used for many years.

What is claimed is:

1. A decorative sheet comprising:

a. a base sheet whose surface is divided into a plurality of unit squares defined by continuous vertical and horizontal grooves which intersect at right angles;

b. a plurality of circular support means each said support means mounted on one of said unit squares, said support means having a bottom surface parallel to said base sheet and in contact therewith, and a top surface formed by two intersecting planes at an angle of about 35° to said base sheet;

c. a plurality of circular sheet means, each circular sheet means having a hole therethrough, said hole having straight sides and circular ends, the length of said hole being 2/15 of the length of a side of said unit square and the width being 1/15 of the length of a side of said unit square; and through d. a plurality of rivets each rivet passing through said hole in one of said circular sheet means and said support means into said base sheet thereby movably mounting said circular sheet means on the top surface of said support mesns said rivet has a hemisphere head having a diameter larger than the width of said hole in said circular sheet and a neck portion with a length and diameter both of 1/15 of the length of a side of said unit square.

2. The decorative sheet of claim 1, wherein said base sheet and said support means are made of thermoplastic synthetic resin.

3. The decorative sheet of claim 1, wherein said base sheet has mounting holes therein.

4. The decorative sheet of claim 1, wherein the height of said support means is 13/30 of the length of a side of said unit square.

5. The decorative sheet of claim 4, wherein said support means is cylindrical and has a diameter of 7/30 of the length of a side of said unit square.

6. The decorative sheet of claim 1, wherein said circular sheet means comprises polycarbonate resinous composition containing polymethyl methacrylate.

7. The decorative sheet of claim 1, wherein said circular sheet means has a reflective surface thereon.

8. The decorative sheet of claim 1, wherein each said circular sheet means has a predetermined color.

9. The decorative sheet of claim 1, wherein each said circular sheet has a predetermined pattern thereon.

* * * * *